US005619315A

United States Patent [19]

Kusumoto et al.

[11] Patent Number: 5,619,315

[45] Date of Patent: Apr. 8, 1997

[54] FIXING APPARATUS USING A COATED ELASTIC MEMBER FOR USE IN AN IMAGE FORMING APPARATUS

[75] Inventors: Yasuhiro Kusumoto; Yasuhiro Uehara; Yoshio Kanesawa; Tohru Inoue, all of Kanagawa; Hiroshi Kato; Hiroyasu Kikukawa, both of Tokyo, all of Japan

[73] Assignees: Fuji Xerox Co., Ltd.; Japan Gore-Tex Inc., both of Tokyo, Japan

[21] Appl. No.: 365,544

[22] Filed: Dec. 28, 1994

[30] Foreign Application Priority Data

Dec. 29, 1993 [JP] Japan ..... 5-353813

[51] Int. Cl.[6] ..... G03G 15/20

[52] U.S. Cl. ..... 399/324

[58] Field of Search ..... 355/282, 285, 355/289, 290, 295, 284; 118/60, DIG. 1

[56] References Cited

U.S. PATENT DOCUMENTS

| | | | |
|---|---|---|---|
| 3,810,735 | 5/1974 | Moser | 432/59 |
| 4,083,322 | 4/1978 | Beckman, Jr. | 118/70 |
| 5,061,965 | 10/1991 | Ferguson et al. | 355/284 |
| 5,210,580 | 5/1993 | Aslam et al. | 355/290 |
| 5,285,248 | 2/1994 | Menjo et al. | 355/284 |
| 5,345,300 | 9/1994 | Uehara et al. | 355/285 |
| 5,345,301 | 9/1994 | Satoh et al. | 355/290 |
| 5,391,450 | 2/1995 | Nagatsuka et al. | 430/99 |
| 5,424,819 | 6/1995 | Menjo | 355/284 |
| 5,482,552 | 1/1996 | Kikukawa et al. | 118/264 |
| 5,485,259 | 1/1996 | Uehara et al. | 355/284 |
| 5,500,722 | 3/1996 | Jacobs | 355/284 |

FOREIGN PATENT DOCUMENTS

| | | |
|---|---|---|
| 0174474 | 3/1986 | European Pat. Off. . |
| 0183903 | 6/1986 | European Pat. Off. . |
| 0291081 | 11/1988 | European Pat. Off. . |
| 0635767 | 1/1995 | European Pat. Off. . |
| 57-20633 | 4/1982 | Japan . |
| 57-205169 | 12/1982 | Japan . |
| 60-8966 | 1/1985 | Japan . |
| 60-33362 | 3/1985 | Japan . |
| 60-238879 | 11/1985 | Japan . |
| 61-11773 | 1/1986 | Japan . |
| 63-62861 | 4/1988 | Japan . |
| 63-62862 | 4/1988 | Japan . |
| 63-172186 | 7/1988 | Japan . |
| 4-52770 | 12/1992 | Japan . |
| 2093769 | 9/1982 | United Kingdom . |
| WO95/09385 | 4/1995 | WIPO . |

*Primary Examiner*—William J. Royer

*Attorney, Agent, or Firm*—Finnegan, Henderson, Farabow, Garrett & Dunner, L.L.P.

[57] ABSTRACT

A fixing apparatus for an image forming apparatus of the present invention includes: a rotatable heat roll; a heat-resistant elastic member fixedly disposed to form a nip section in contact with an outer circumferential surface of the heat roll, the heat-resistant elastic member being impregnated with a liquid release agent which is supplied to the nip section; and a porous fluororesin film formed by sintering a fluororesin powder for coating a surface of the heat-resistant elastic member coming in contact with the heat roll so that the release agent can be supplied by a predetermined amount while permeating through the film. The porous fluororesin film may include: a film formed by using metal fibers, glass fibers, or the like as a supporting member thereof, and a film formed by applying a gelled dimethyl silicone oil at least to a single surface of the film.

20 Claims, 2 Drawing Sheets

FIXING APPARATUS USING A COATED ELASTIC MEMBER FOR USE IN AN IMAGE FORMING APPARATUS

BACKGROUND OF THE INVENTION

1. Field of the Invention

The present invention relates to a fixing apparatus used for image forming apparatuses utilizing an electrophotographic process such as copying machines, facsimile machines, and printers.

2. Description of the Related Art

In copying machines and the like utilizing the electrophotographic process, it is necessary to fix a nonfixed toner image formed on a recording sheet to render the image into a permanent image. Generally, a heat fixing method involving the step of fixing the toner by heating to deposit the fixed toner on the recording sheet is extensively used.

As the heat fixing apparatus, well known is a heat roll type fixing apparatus including: a heater inside a cylindrical core member; a heat roll having a heat-resistant resin coating layer on the outer circumferential surface thereof; and a pressure roll being disposed in pressure contact with the heat roll and having a heat-resistant elastic layer formed on the outer circumferential surface of a cylindrical core member thereof. The heat fixing apparatus is designed to deposit a nonfixed toner image by causing a recording sheet having such nonfixed toner image thereon to pass through the space between these rolls.

Such a heat roll type fixing apparatus employs the pressure roll as described above, and an expensive heat-resistant elastic material such as silicone rubber or fluororesin rubber must be used to form the heat-resistant elastic layer on the roll surface in order to manufacture the pressure roll, thereby having the problem of elevated cost of manufacture of the fixing apparatus. In addition, to insure a desirable fixing condition, the width of contact between the heat roll and the pressure roll (i.e., the width of the nipping section) have to be within the range of about 4 to 10 mm, which required, e.g., that the roll diameter is set to rather large values or that a loading mechanism for applying a high load is disposed. This has made it difficult to downsize both the heat roll and the pressure roll, which in turn makes the apparatus large and complicated in structure as a whole.

To overcome the above problems, for example, a fixing apparatus has been suggested, to which applied is a heat-resistant elastic member having a semi-circular shape in section is fixedly disposed in place of the aforementioned pressure roll so that the nipping section can be formed so as to be in pressure contact with the heat roll (Unexamined Japanese Utility Model Publication No. Sho. 61-156675). Since the pressure roll is not necessary, this conventional fixing apparatus has been successful in implementing the cost reduction as well as downsizing of the apparatus.

However, even with this fixing apparatus, various improvements are called for to meet the increasing needs in recent years for a further downsizing, cost reduction, higher performance of the apparatus and the like.

Moreover, how the recording sheet having a nonfixed toner image can reliably and smoothly be threaded in and passed through the nip section formed between the heat roll and the heat-resistant elastic member by pressure contact is another important subject to be overcome with such fixing apparatus. It should be noted that if the conventional supply unit for supplying a release agent to the heat roll and the like is arranged to achieve satisfactory threading and the like of the recording sheet, not only the structure of the fixing apparatus is as much increased in size, but also the cost of manufacture is as much elevated as a whole as the supply unit.

SUMMARY OF THE INVENTION

It is an object of the present invention to provide a fixing apparatus, which is of such type that a heat-resistant elastic member is used in place of a pressure roll so that not only the downsizing and cost reduction of the unit can be achieved, but also simple and stable supply of a release agent as well as satisfactory threading of a recording sheet having a nonfixed toner image thereon can be implemented.

Accordingly, fixing apparatus for an image forming apparatus of the present invention is comprised of a rotatable heat roll; a heat-resistant elastic member fixedly disposed to form a nip section in contact with an out circumferential surface of the heat roll, the heat-resistant elastic member being impregnated with a liquid release agent which is supplied to the nip section; and a porous fluororesin film formed by sintering a fluororesin powder for coating a surface of the heat-resistant elastic member coming in contact with the heat roll so that the release agent can be supplied by a predetermined amount while permeating through the film.

According to the invention, the heat-resistant elastic member forms the nip section in cooperation with the heat roll and, at the same time, functions as a release agent supply unit. As a result, the release agent supply unit disposed around the heat roll in the conventional unit is no longer necessary, thus allowing the downsizing and cost reduction of the unit to be achieved. Particularly, since the porous fluororesin obtained by sintering the fluororesin powder is coated on the heat-resistant elastic member, not only the uniform and stable supply of the release agent can be effected in the nip region of the heat-resistant elastic member, but also satisfactory threading of a recording sheet can be implemented.

Therefore, the recording sheet having a nonfixed toner image formed thereon is nipped and forwarded at the nip section, so that the nonfixed toner is fixed by heat and pressure and the recording sheet is satisfactorily released from the heat roll by the appropriate amount of the release agent discharged from the nip section.

BRIEF DESCRIPTION OF THE DRAWINGS

In the accompanying drawings.

DETAILED DESCRIPTION OF THE INVENTION

The detailed description of the present invention will be described referring to the accompanying drawings.

Figure 1:
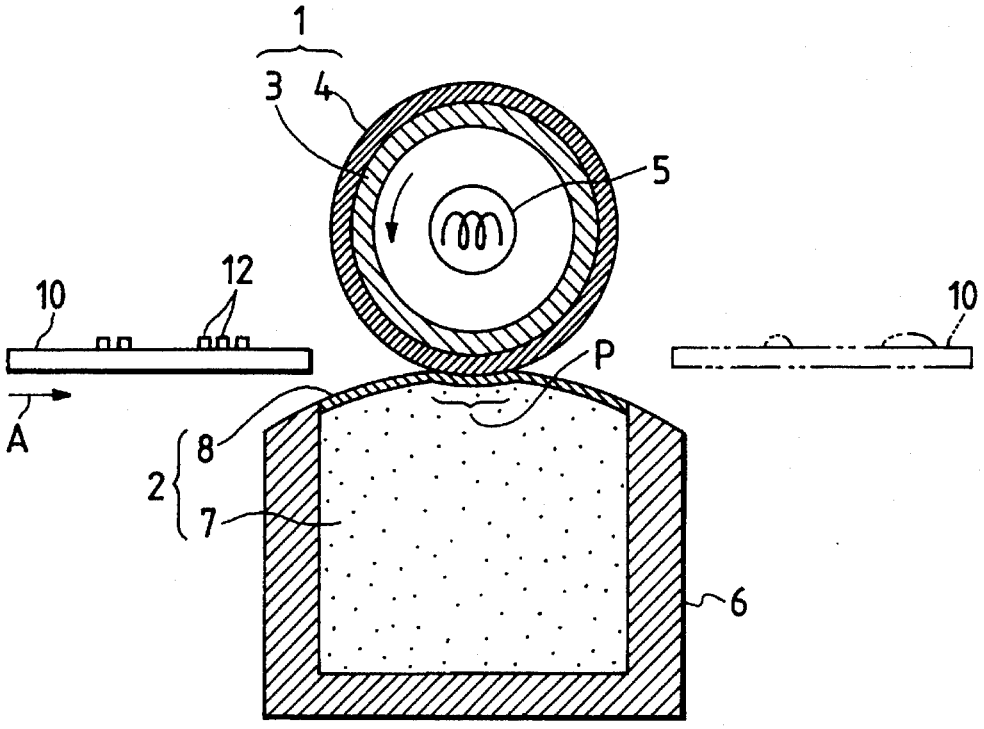
FIG. 1 is a general sectional view of a fixing apparatus, which is an embodiment of the invention.

As shown in FIG. 1, a toner image fixing apparatus of the present invention includes a heat roll 1 and a heat-resistant elastic member 2 having a porous fluoropolymer film 8 and an elastic silicone rubber sponge 7. The silicone rubber sponge 7 is disposed in a fixed portion in a holder 6. The silicone sponge has a curved surface, covered by a porous fluoropolymer 8 formed of sintered fluoropolymer powder, which projects above the holder 6. The silicone rubber sponge is impregnated with a liquid release agent which is distributed through the porous fluoropolymer film 8 to the nip section formed by contact between the porous fluoropolymer film 8 and the roll 1.

The elastic body of the present invention can be impregnated with a liquid release agent and, in addition, can produce a pressure (a restitutive force of about 0.1 to 2.0 $kg/cm^2$) necessary for fixing and deposition of toner when brought into contact with the heat roll. The material of the elastic body may be made of a porous material, a foaming material, and the like. The elastic body is impregnated with a predetermined amount of a release agent that is to be supplied to a nip section where the elastic body comes in slidably contact with the heat roll.

The porous fluororesin film is formed at least on a surface of the elastic body forming the heat-resistant elastic member which comes in contact with the heat roll. This film controls the amount of the release agent supplied to the nip section while permeating through the film, the release agent having impregnated the elastic body. Basically, a film that is formed by sintering a fluororesin power is used as the porous fluororesin film. As the fluororesin powder, the powder of fluororesin such as polytetrafluoroethylene, polychlorotrifluoroethylene, tetrafluoroethylene-hexafluoropropylene copolymers, tetrafluoroethylene-ethylene copolymers, tetrafluoroethylene-perfluoroalkylvinylether copolymers, and tetrafluoroethylene-hexafluoropropylene-perfluoroalkylvinylether copolymers may be used.

The porous nature of the film formed by this baking depends on the particulate nature of the granular polymer which is used to form it. The baking conditions are chosen such that the polymer particles become partially fused or sintered into an integral porous network during baking. Accordingly, it is preferable in the present invention to employ granular polytetrafluoroethylene (PTFE). As is well known, PTFE can exist in two quite different forms viz; the granular form produced by precipitation polymerization method, and the powdered form produced by dispersion polymerization processes. In the present invention, it is preferable to employ the former form.

Unsintered or unbaked granular PTFE having a crystallinity in excess of 95%, or sintered or baked PTFE having a crystallinity of less than 95% can be used in the present invention. The particles themselves are preferably substantially pure granular PTFE, possibly including minor amounts of other materials, such as filler. The average particle size is usually in the range of 1 to 500 μm, preferably 1 to 200 μm, particularly, 1 to 100 μm. Depending on the desired porosity of the structure, the particle may have substantially the same particle size, or a range of varying particle sizes may be included which pack so as to influence the porosity of the structure. One preferred embodiment is to use mixture of particles of weight average particle sizes 20 to 50 μm to 30 and 60 μm. The granular PTFE may be milled or unmilled.

The preferable granular polytetrafluoroethylene is, for example, teflon granular type PTFE fluorocarbon resin GRADE 7A and 9B which can be sold by Du Pont Specialty Polymers Division, Willmington, USA. The GRADE 9B is a previously molten and sintered resin. The average particle size of the GRADE 7A is 35 μm and that of the GRADE 9B is 500 μm before being milled, which are properly milled to use.

A method of forming the porous film preferable to the present invention from the granular polytetrafluoroethylene is, for example, specifically disclosed in Unexamined Japanese Patent Publication No. Hei. 6-93123. Namely, the structure is generally formed by spraying a suspension comprising particles of granular PTFE, allowing to dry and baking at a temperature usually in the range of 335° to 350° C. for 0.5 to 3 hours. Generally, the process is conducted at substantially atmospheric pressure. The suspension is usually an aqueous suspension comprising appropriate surfactants, thickening agents and/or suspending agents. The temperature may be progressively raised over some hours e.g. 1 to 10 hours in order to remove such additives, prior to baking. If desired, there may be also included fillers such as active carbon, glass, chromium oxide or titanium oxide. Spraying is usually more suitable for particles of lower particle size, for example 1 to 200 μm. Larger particle sizes may be applied by other liquid coating technique such as Dipping method. The thickness of the structure varies depending on the required permeability and physical strength. A porous PTFE coating may simply overlie the substrate, or the substrate may be embedded in the coating.

The sintering or baking as mentioned above or later is conducted so as to partially fuse or sinter the polymer particles to form the integral porous network. Accordingly, the condition (temperature or the like ) has to be within the range in which the original shape of the polymer can be remained. Therefore, the temperature of the sintering or baking depends on a kind of polymer. For example, in a polymer such as polytetrafluororesin (PTFE) (melting point: 330° C.) as mentioned above, having a extremely high viscosity to remain the original shape of the particles thereof even if the polymer is heated to melt, the temperature is set to be higher than the melting point thereof. In case of PTFE, the temperature is set to 10 to 50° C. higher than the melting point thereof or more. On the other hand, a polymer whose melting viscosity is lowered to be difficult to remain the original shape thereof if it is heated at more than the melting point, such as polychlorotrifluoroethylene, tetrafluoroethylene/hexafluoropropylene copolymer, tetrafluoroethylene/ethylene copolymer or tetrafluoroethylene/perfluoroalkylvinylether copolymer, have to be sintered or baked at the temperature which is less than but in the vicinity of the melting point thereof.

The porous fluororesin film thus obtained by sintering the fluororesin powder exhibits a small frictional resistance at the time of coming in pressure contact with the heat roll and, therefore, has an excellent wear resistance compared with, e.g., an expanded porous fluororesin film prepared by forming a fluororesin into a film by an ordinary method and then expanding the film. In addition, the former is advantageous in the cost of manufacture compared with the latter under the same thickness and area conditions. Further, the former is excellent in threading and sheet forwarding of a recording sheet. By the term "threading" it is intended to mean a function that allows the head end of the recording sheet to be bitten and pulling in by the nip section, and by the term "sheet forwarding" it is intended to mean a function that allows the recording sheet bitten by the nip section to pass through the nip section by forwarding.

The film formed by sintering the fluororesin powder has a thickness of 30 to 500 μm, or more preferably, 50 to 100 μm. To improve the threading and sheet forwarding performance of this film, the thickness of the film may be reduced. The porosity of the film may preferably be set to an appropriate value within the range of 30 to 95%. By the term "porosity", it is intended to mean the ratio of the area of the interstices to the sum of the area of the film excluding the interstices and the area of the interstices.

Used as the porous fluororesin film in the aforementioned technical means is a film formed by sintering a fluororesin powder to a supporting member formed of metallic fibers. This film, having high surface hardness, exhibits excellent threading and sheet forwarding even for thick recording sheets. Having excellent internal tearing strength, this film is also advantageous in terms of life even if the film is relatively thin.

Stainless steel fibers, aluminum fibers, or the like are used as the metallic fibers. Such metallic fibers are formed into some 20- to 100-mesh meshed body by, e.g., plain weaving (the mesh designating the size of a screen in terms of the number of openings per inch). The thickness of such meshed body is preferably about 50 to 200 μm. The aforementioned film can be obtained by sintering the fluororesin powder such as polytetrafluoroethylene to the thus prepared metallic fibers. The total thickness of the film as a whole preferably ranges from 250 to 350 μm.

The above mentioned producing method of the porous film can be applied to the overlaying and sintering of the fluororesin powder on the supporting member formed by the metallic fiber. The method will specifically be described in the following example 3.

Further, a film formed by sintering a fluororesin powder to a supporting member formed of glass fibers is also used as the aforementioned porous fluororesin film. This film is advantageous in reducing the cost of manufacture compared with the film using the metallic fibers as the supporting member.

Still further, a film formed by first coating polytetrafluoroethylene on a surface of the supporting member formed of glass fibers and sintering a fluororesin powder to the thus coated supporting member is also used as the aforementioned porous fluororesin film. Specifically, polytetrafluoroethylene is coated to such a degree as not to bury the interstices between the glass fibers (the interstices of the meshed body), and a fluororesin powder is then sintered to this supporting member to form a film. This film is advantageous in maintaining a low cost and exhibiting satisfactory threading and sheet forwarding substantially equal to the film made of a metallic fiber as the supporting member.

The polytetrafluoroethylene coated supporting member thus formed by the glass fiber is made by coating the aqueous dispersion liquid of polytetrafluoroethylene powder on the supporting member made of the glass fiber by a dipping method, spraying method or the like, and drying and baking by normal process such as using a hot air over.

Further, a film formed by applying a gelled dimethyl silicone oil at least to a single side thereof can also be used as the porous fluororesin film in the aforementioned technical means. To adjust the amount of the release agent passed, a method of adjusting the viscosity of the release agent or a method of adjusting the porosity of the porous film is generally available. However, the former method is disadvantageous in that the frictional force on the porous film surface is so increased with increasing viscosity that a recording sheet is no longer forwarded. The viscosity defining the instance in which the recording sheet is no longer forwarded is about 100,000 centistokes (at room temperature). On the other hand, the latter method is disadvantageous in that it is difficult to control the size and amount of the interstices in the film to adjust the porosity during the sintering process.

To overcome these disadvantages, it is preferable to the porous fluororesin film of the present invention that a gelled dimethyl silicone oil is applied to a surface thereof in the side of the elastic member impregnated with a liquid release agent, whereby a permeation amount of the release agent can be adjusted. Similarly, the gelled dimethyl silicone oil can be applied to a surface coming in contact with the heat roll so as to adjust the permeation amount of the release agent.

In addition, the method for applying the gelled dimethyl silicone oil is suggested in Unexamined Japanese Patent Publication No. Sho. 62-178992, and disclosed in Unexamined Japanese Patent Publication Nos. Hei. 3-204672, 6-214479, 6-269711 or the like. According to the method disclosed in Unexamined Japanese Patent Publication No. Hei. 6-269771, a mixture of silicone rubber and dimethyl silicone oil as release oil is impregnated into the porous material, after which the silicone rubber is cross-linked. Then, pores of the porous material are filled with the cross-linked silicone rubber involving the dimethyl silicone oil as the release oil. Preferable silicone rubber is RTV (room temperature vulcanization) silicone rubber, LTV (low temperature vulcanization) silicone rubber, HTV (high temperature vulcanization) silicone rubber, ultraviolet light setting type silicone rubber or the like. Dimethyl silicone oil is preferable to function as the release oil so as to prevent adhering the toner to the fixing roller and the abrasion of the fixing roller. The condition of the mixture of the silicone rubber and release oil is changed from the solid state to the gelled state in accordance with the mixing ratio thereof. The mixing ratio (weight ratio) of the mixture of the silicone rubber and the release oil is in the range of 90:10 to 2:98, preferably, 50:50 to 5:95. If the ratio of the silicone rubber is lager than 90 (weight ratio), it becomes extremely difficult that the release oil involved in the silicone rubber moves from the mixture to the applied member (heating roller member). If the ratio of the silicone rubber is smaller than 2 (weight ratio), the silicone rubber can not involve the release oil therein so as to be un-gelled condition, thereby causing the leak of the oil. In addition, the above-mentioned adjustment of the permeation amount of the release agent is conducted by the change of the gelled condition according to the change of the mixing ratio of the silicone rubber and dimethyl silicone oil as the release oil.

It is preferable that the surface of the heat-resistant elastic member which comes in contact with the heat roll has a shape whose radius of curvature is greater than the radius of the heat roll. As a result of this construction, a large nip width can be obtained with ease, thus contributing to the implementation of a smaller-diameter heat roll as well as a higher-speed fixing operation. Specifically, the nip width provided by the invention is approximately twice (1/5 to 1/2.5 times) the conventional limit that is 1/10 to 1/5 times the diameter of the heat roll in the conventional roll type fixing apparatus. For example, the heat roll and the pressure roll, each having a diameter of 15 mm, provides a nip width of only 2 to 3 mm in the conventional example. However, the present invention can provide a nip width of 5 to 6 mm with ease by using a elastic member in place of the aforementioned pressure roll and making the radius of curvature in the nip region to be 40 mm or more.

On the other hand, the heat roll of the invention has a heater inside the cylindrical core member and has a release layer having the toner releasing capability formed on the outer circumferential surface thereof. A release layer made of silicone rubber or fluororubber is preferably used. More specifically, a rubber layer made of HTV (High Temperature Vulcanization) silicone rubber, RTV (Room Temperature Vulcanization) silicone rubber, or fluororubber having excellent heat-resistance and toner releasing capability is desirable. In addition, since the heat roll must forward a recording sheet by rotation thereof while holding the recording sheet, the friction coefficient of the heat roll with respect to the recording sheet must be higher than that of the heat-resistant elastic member. Accordingly, excellent threading and sheet forwarding can be insured.

Figure 3:
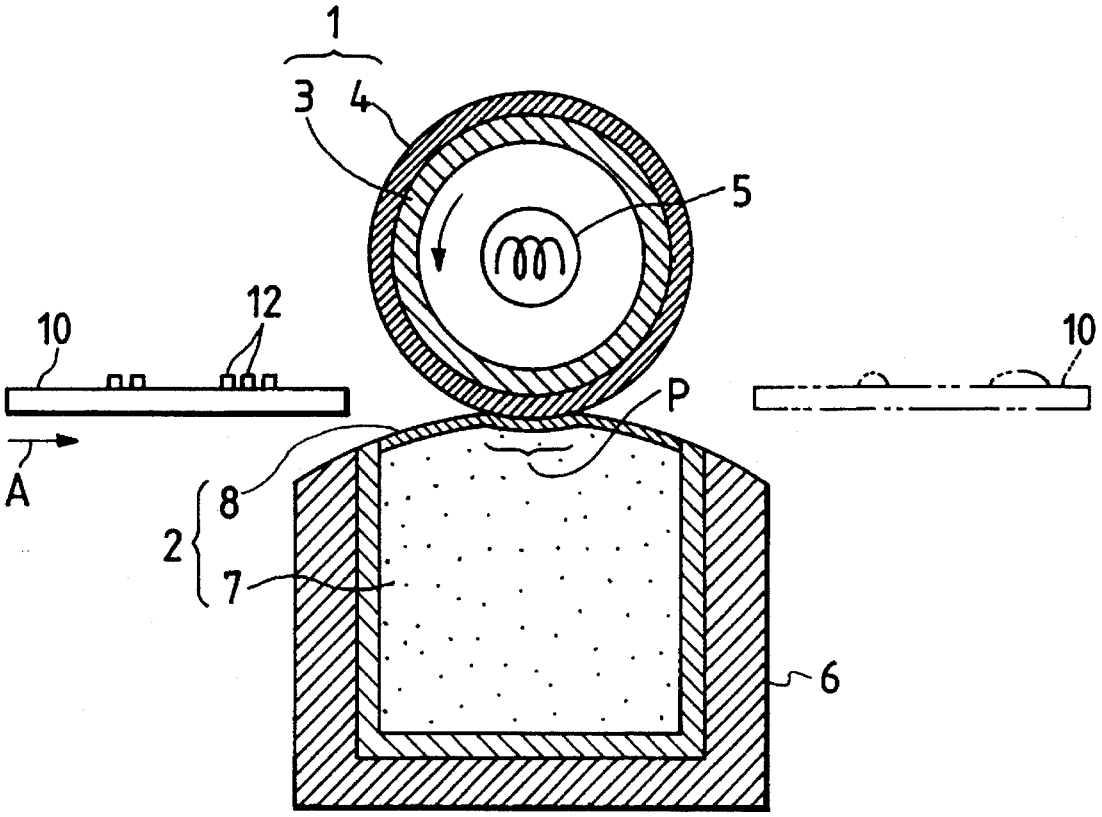
FIG. 3 is a general section view of a fixing apparatus, which is another embodiment of the invention.

The porous fluororesin film formed by sintering the fluororesin powder is mounted onto the heat-resistance elastic member. The porous fluororesin film having microholes is mounted so that the release agent impregnated with the heat-resistance elastic member can permeate through it. Specifically, the porous fluororesin film is previously fused to the heat-resistance elastic member, and thereafter, the release agent is impregnated with the elastic member. An example of such a structure is shown in FIG. 1. With respect to the heat fusing, it is not necessary to worry about lowering the adhesive strength by the release agent. An adhesive may be used for the mounting, however, the adhesive must have a deterioration resistance against the release agent. Further, in case of adhering, it is important so as not to bury holes of the porous fluororesin film. The adhesion may be conducted to an area except the nip portion formed between the heat roll and the film. In addition, as shown in FIG. 3, the porous fluororesin film may disposed so as to wrap the surface of the heat-resistance elastic member, thereby being disposed into a housing. In this case, the release agent may be previously impregnated with the heat-resistance elastic member before wrapping the elastic member, or applied from an appropriate portion to the film so as to be impregnated after wrapping the elastic member.

Since the invention allows a large nip width to be obtained with ease by having replaced the conventional pressure roll with an elastic member, a heat roll having a diameter smaller than that of the conventional heat roll can be used. The reduction in the diameter of the heat roll contributes not only to improving the releasing capability of the recording sheet from the heat roll, but also to downsizing the unit, reducing the cost of manufacture of the unit, and implementing quick start of the unit.

The liquid release agent with which the elastic member is impregnated is not particularly limited. As the release agent, the silicone oil having a general structure of polysiloxane can be used. One unit structure of polysiloxane is indicated by the following general formula.

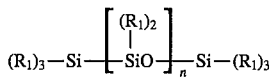

Here, n indicates an integer number from 1 to 1000, and R1 indicates an alkyl or aryl group having from 1 to 8 carbon atoms. Specifically, the alkyl group is a methyl, ethyl, propyl, butyl, pentyl, hexyl, heptyl, octyl or the like group, and the aryl group is a phenyl, tolyl or the like group. Especially, dimethyl silicone oil ($R_1$=—$CH_3$) is most preferable. In addition, denatured silicone oil is also appropriate, for example, the silicone oil is denatured by mercaptan or amine. For example, a silicone oil whose viscosity ranges from 50 to 100,000 centistokes (at room temperature) can be used. Further, the amount of the release agent supplied per A4 sheet is in the order of 0.1 to 80 mg/copy although the amount depends on the releasing capability of the toner itself. In the case of an oil-less toner containing wax extensively used in small-sized copying machines, the amount is in the order of 0.1 to 5.0 mg/copy.

The examples of the invention are described as follows.

EXAMPLE 1

FIG. 1 shows a fixing apparatus, which is an example of the invention. In FIG. 1, reference numeral 1 denotes a heat roll; 2, the heat-resistant elastic member fixedly disposed so as to come in pressure contact with a part of the outer circumferential surface of the heat roll 1; 10, a recording sheet; 12, nonfixed toner portions formed on the recording sheet 10; and an arrow A, a recording sheet forwarding direction.

The heat roll 1 has a release layer 4 formed by dip-coating silicone RTV rubber on the outer circumferential surface of a cylindrical core member 3 made of iron so that the thickness of the coating is 30 μm. The core member 3 has an outer diameter of 15 mm, a thickness of 0.3 mm, and a roll length of 225 mm. Inside the hollow portion of this heat roll 1, a 100 V/300 W infrared lamp as a heat source 5 is provided.

The heat-resistant elastic member 2 is made of the silicone sponge 7 and the porous tetrafluoroethylene film 8 (whose porosity is 50%). The silicone sponge 7 is accommodated in a metallic supporting body 6 having an opening on top thereof (the rubber hardness of the sponge 7 is: 35°±3° according to the result of a measurement made with an ASKER C-type rubber and plastic hardness meter manufactured by KOBUNSHI KEIKI CO., LTD. under a load of 300 g). The porous tetrafluoroethylene film is formed by sintering a tetrafluoroethylene powder so as to serve as a porous fluororesin film 8 covering a surface of the sponge 7 which comes in contact with the heat roll 1.

The porous polytetrafluoroethylene film of example 1 is formed based on the method of Embodiment 1 of Unexamined Japanese Patent Publication No. Hei. 6-93123. The thickness of the film is changed as described in Table 1, the porosity of any film is about 50 %, and the average diameter of the pore is about 5 μm. In addition, the contact of the film and the silicone sponge elastic member is performed by a mechanical fitting using a holder.

The surface of the aforementioned elastic member 2 (sponge 7) which comes in contact with the heat roll 1 is a curved surface whose radius of curvature is 60 mm with the thickness of the apex thereof being 20 mm. The nip section P formed by this elastic member 2 has a width as large as 6 mm (under a load of 8 kg) despite the fact that the diameter of the heat roll is small.

Further, the sponge 7 is impregnated with 100 g of 10,000-centistokes dimethyl silicone oil as the release agent. The amount of the oil supplied is set to about 1 mg/copy by the porous film 8.

Still further, the nip section P of the elastic member 2 has a thermistor (not shown) interposed between the elastic body 7 and the film 8, the thermistor serving as a temperature sensor. A detected temperature signal from the sensor is fed back to a not shown heat roll temperature control circuit, so that the heating temperature is maintained at 150° C.

Then, the following test was carried out using the thus constructed fixing apparatus.

The test was carried out on three types of recording media by varying the thickness of the porous film 8 according to values shown in Table 1 to evaluate the threading and sheet forwarding capability toward these recording media. The three recording media are: an ordinary paper (L-type paper whose basis weight is 64 g/$m^2$ manufactured by Fuji Xerox Co., Ltd.), a postal card (sold by the Japanese Government Postal Service) and an envelope (whose thickness is about 370 μm), which are thicker than the ordinary paper. The results of the test are shown in Table 1.

O: Both threading and sheet forwarding are good

: Either threading or sheet forwarding is sometimes impossible.

X: Neither threading nor sheet forwarding is possible.

TABLE 1

| Thickness of porous film (μm) | 30 | 50 | 100 | 150 | 200 | 250 | 300 | 350 | 400 | 450 | 500 | 550 |
|---|---|---|---|---|---|---|---|---|---|---|---|---|
| Ordinary paper | ○ | ○ | ○ | ○ | ○ | ○ | ○ | ○ | ○ | Δ | Δ | X |
| Postal card | ○ | ○ | ○ | ○ | ○ | Δ | Δ | Δ | X | X | X | X |
| Envelope | ○ | ○ | ○ | Δ | Δ | Δ | X | X | X | X | X | X |

It is understood from Table 1 that the range of thickness of the porous film 8 with which sheet threading and forwarding are possible is between 30 and 500 μm for the ordinary paper, whereas such range is between 30 and 350 μm for the postal card and between 30 and 250 μm for the envelope. Thus, in the case where the film body formed by sintering the polytetrafluoroethylene powder alone is used as the porous film 8, satisfactory threading and sheet forwarding can be insured by reducing the thickness of the film to achieve satisfactory fixing with recording media thicker than the ordinary paper.

EXAMPLE 2

A fixing apparatus according to this example is designed in a manner similar to that of Example 1 except that the porous film 8 is a film formed by sintering a tetrafluoroethylene powder to a supporting member formed of metallic fibers.

That is, the porous film in this example is a film (whose porosity is 50%) formed by sintering a polytetrafluoroethylene powder to a 40-mesh meshed body (whose thickness is 100 μm) that is prepared by plainly weaving stainless steel fibers.

The porous film of example 2 is formed based on the method of embodiment 3 of Unexamined Japanese Patent Publication No. Hei. 6-93123.

Then, by using this fixing apparatus, a test was carried out on the same three types of recording media as in Example 1 to evaluate threading and sheet forwarding with respect to these recording media by varying the thickness of the porous film according to values shown in Table 2. The results of the test are shown in Table 2.

TABLE 2

| Thickness of porous film (μm) | 250 | 300 | 350 |
|---|---|---|---|
| Ordinary paper | ○ | ○ | ○ |
| Postal card | ○ | ○ | ○ |
| Envelope | ○ | ○ | ○ |

It is understood from Table 2 that satisfactory threading and sheet forwarding can be observed with respect to all the three recording media when the thickness of the porous film formed of the metallic fibers as the supporting member ranges from 250 to 350 μm.

EXAMPLE 3

A fixing apparatus according to this example is designed in a manner similar to Example 2 except that glass fibers are used as the supporting member of the porous film in place of the metallic fibers.

The supporting member made of the glass fibers is a plainly woven heat-resisting glass cloth having the thickness of 200 μm, gas permeability of 30 to 35 $cm^3/cm^2/sec.$, and heat-resistant of 300° C.

Then, using this fixing apparatus, a test was carried out on the same three types of recording media as in Example 1 to evaluate threading and sheet forwarding with respect to these media by varying the thickness of the porous film according to values shown in Table 3. The results of the test are shown in Table 3.

TABLE 3

| Thickness of porous film (μm) | 250 | 300 | 350 |
|---|---|---|---|
| Ordinary paper | ○ | ○ | ○ |
| Postal card | ○ | Δ | Δ |
| Envelope | ○ | ○ | ○ |

EXAMPLE 4

A fixing apparatus according to this example is designed in a manner similar to Example 3 except that a polytetrafluoroethylene resin solution is coated on glass fibers serving as the supporting member of the porous film.

That is, the porous film in this example is formed by sintering a polytetrafluoroethylene powder to a supporting member made by coating a polytetrafluoroethylene resin solution on a meshed body of glass fibers to such a degree as not to bury the interstices of such meshed body.

In this example, the precoating of polytetrafluoroethylene on the supporting member made of the glass fiber is conducted based on Unexamined Japanese Patent Publication No. 6-93123.

Then, using this fixing apparatus, a test similar to that in Example 1 was carried out on the same three types of recording media as in Example 1 to evaluate threading and sheet forwarding with respect to these media by varying the thickness of the porous film according to values shown in Table 4. The results of the test are shown in Table 4.

TABLE 4

| Thickness of porous film (μm) | 250 | 300 | 350 |
|---|---|---|---|
| Ordinary paper | ○ | ○ | ○ |
| Postal card | ○ | ○ | ○ |
| Envelope | ○ | ○ | ○ |

It is understood from Table 4 that satisfactory threading and sheet forwarding was observed with respect to all the three recording media when the thickness of the porous film using the polytetrafluoroethylene-coated glass fibers as the supporting member ranges from 250 to 350 μm.

It is also verified that the porous film of this example exhibited satisfactory performance for a fixing operation involving 100,000 sheets (the aforementioned L-type sheet in A4 size).

EXAMPLE 5

A fixing apparatus according to this example is designed in a manner similar to Example 3 except that a gelled dimethyl silicone oil is applied to a side of the elastic member 2 made of the film of Example 3, the side coming in contact with the sponge 7.

Figure 2:
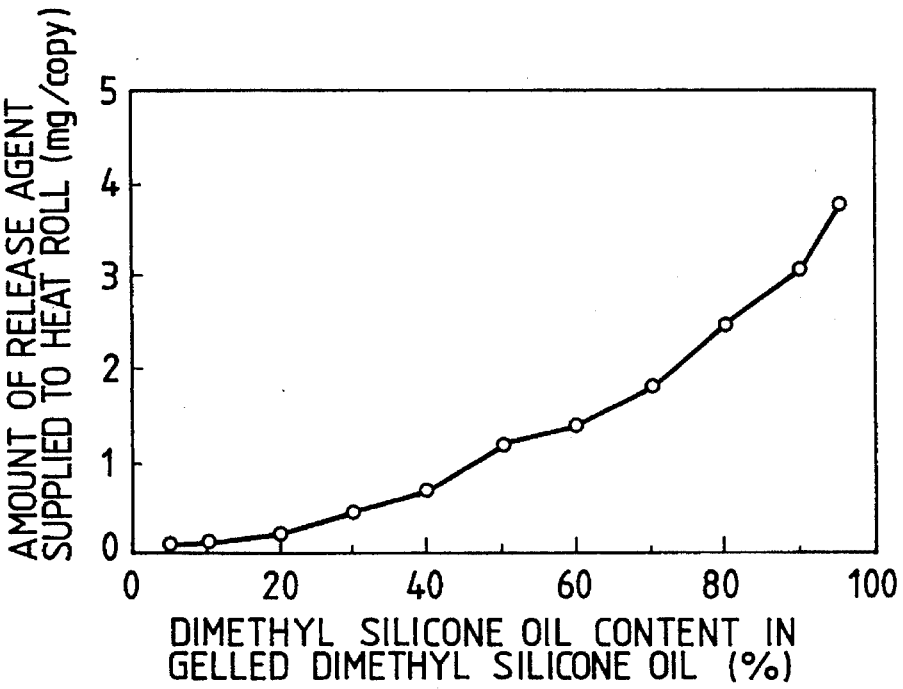
FIG. 2 is a diagram showing a relationship between dimethyl silicone oil content in gelled dimethyl silicone oil and the amount of release agent supplied to a heat roll in example 5.

RTV silicone rubber KE-106 (produced by Shinetsu Kagaku Kogyo Co., Ltd.) is used as the gelatinizer of the gelled dimethyl silicone. Dimethyl silicone oil KF-96-10000 CS (produced by Shinetsu Kagaku Kogyo Co., Ltd.) is used as the oil. The mixing ratio (based on weight) of the silicone rubber and silicone oil is changed to various ratios as shown in FIG. 2. Each of thus prepared mixtures is applied to and impregnated with the surface of the porous film in the side contacting to the elastic member 7. Then, the excess part is scraped, after which the film is heated at 150° C. for 40 minutes so that the mixture of the silicone rubber and the silicone oil is cross-linked to obtain the film with which the film permeation amount of the release agent (oil) is adjusted. FIG. 2 shows a relationship between the amount of the release agent supplied to the heat roll and the dimethyl silicone oil content in the gelled dimethyl silicone oil.

That is, the oil-permeability of the porous film was varied by applying the gelled dimethyl silicone oil to adjust the amount of the release agent passed by the film. It should be noted for reference that a relationship between the dimethyl silicone oil content in gelled dimethyl silicone oil of the porous film and the amount of the release agent supplied to the heat roll under this condition is shown in FIG. 2.

As described in the foregoing, the invention is particularly characterized by providing various types of porous fluororesins obtained by sintering the fluororesin powder to the heat-resistant elastic member. Therefore, not only uniform and stable supply of the release agent can be insured at the nip region formed between the heat roll and the heat-resistant elastic member, but also satisfactory threading of a recording sheet can be achieved. Therefore, the recording sheet having a nonfixed toner image thereon is bitten into and forwarded through the nip section satisfactorily, which allows consistent and satisfactory fixing to be achieved.

Further, the release agent supply unit that has been disposed around the heat roll in the conventional unit is no longer necessary and, in addition, the diameter of the heat roll can be reduced. As a result, a larger scale of downsizing and cost reduction of the unit can be achieved.

What is claimed is:

1. A fixing apparatus for an image forming apparatus comprising:

a rotatable heat roll;

a fixed elastic member disposed to form a nip section in contact with an outer circumferential surface of said heat roll, said nip section being adapted to receive a recording sheet, and said elastic member being impregnated with a liquid release agent which is supplied to said nip section; and a porous fluororesin film formed by sintering a fluororesin powder for coating a surface of said elastic member coming in contact with said heat roll so that the release agent can be supplied by a predetermined amount while permeating through said film.

2. A fixing apparatus according to claim 1, wherein said porous fluororesin film is a film formed by sintering a fluororesin powder to a supporting member made of metallic fibers.

3. A fixing apparatus according to claim 2, wherein a gelled dimethyl silicone oil is applied at least to one surface of the porous fluororesin film so that a permeation amount of the release agent can be adjusted.

4. A fixing apparatus according to claim 2, wherein a thickness of a meshed body of said metallic fibers is in the range of 50 to 200 μm.

5. A fixing apparatus according to claim 4, wherein a thickness of said porous fluororesin film formed by sintering a fluororesin powder to a supporting member made of metallic fibers is in the range of 250 to 350 μm.

6. A fixing apparatus according to claim 1, wherein the porous fluororesin film is a film formed by sintering a fluororesin powder to a supporting member made of glass fibers.

7. A fixing apparatus according to claim 6, wherein a gelled dimethyl silicone oil is applied at least to one surface of the porous fluororesin film so that a permeation amount of the release agent can be adjusted.

8. A fixing apparatus according to claim 6, wherein a surface of the glass fibers serving as the supporting member are coated by polytetrafluoroethylene in advance on a surface of the fibers.

9. A fixing apparatus according to claim 8, wherein a gelled dimethyl silicone oil is applied at least to one surface of the porous fluororesin film so that a permeation amount of the release agent can be adjusted.

10. A fixing apparatus according to claim 1, wherein a gelled dimethyl silicone oil is applied at least to one surface of the porous fluororesin film so that a permeation amount of the release agent can be adjusted.

11. A fixing apparatus according to claim 1, said elastic member comprises:

an elastic body having a restitutive force in the range of 0.1 to 2.0 kg/cm$^2$ necessary for fixing and deposition of toner when brought into contact with the heat roll; and supporting body for supporting said elastic body.

12. A fixing apparatus according to claim 1, wherein a thickness of said porous fluororesin film is in the range of 30 to 500 μm.

13. A fixing apparatus according to claim 12, wherein the thickness of said porous fluororesin film is in the range of 50 to 100 μm.

14. A fixing apparatus according to claim 1, wherein a porosity of said porous fluororesin film is in the range of 30 to 95%.

15. A fixing apparatus according to claim 1, wherein said heat roll comprises a heater inside a cylindrical core member and a release layer having a toner releasing capability formed on an outer circumferential surface thereof.

16. A fixing apparatus according to claim 15, wherein said release layer comprises one of silicone rubber and fluororubber.

17. A fixing apparatus according to claim 16, wherein said release layer comprises at least one of a rubber layer made of HTV (High Temperature Vulcanization) silicone rubber, RTV (Room Temperature Vulcanization) silicone rubber, and fluororubber.

18. A fixing apparatus according to claim 1, wherein a frictional coefficient of said heat roll with respect to a recording sheet is higher than that of said elastic member.

19. A fixing apparatus for an image forming apparatus comprising:

a rotatable heat roll;

a liquid release agent source covered with a porous fluororesin film, said release agent source located adjacent to said heat roll and forming a nip region adapted to receive a recording sheet where said heat roll and said porous fluororesin film come into contact, and said porous fluororesin film controls the amount of release agent supplied to said nip region.

20. A fixing apparatus according to claim 19, wherein said release agent source comprises an elastic member impregnated with a liquid release agent.

* * * * *